United States Patent [19]

Le Mert

[11] 4,337,684

[45] Jul. 6, 1982

[54] OUTRIGGER HOLDER ASSEMBLY FOR PERCUSSION MUSICAL INSTRUMENTS

[75] Inventor: Alfred J. Le Mert, Mount Prospect, Ill.

[73] Assignee: Ludwig Industries, Chicago, Ill.

[21] Appl. No.: 236,768

[22] Filed: Feb. 23, 1981

[51] Int. Cl.[3] ..... G10D 13/02

[52] U.S. Cl. ..... 84/421

[58] Field of Search ..... 84/421, 422

[56] References Cited

U.S. PATENT DOCUMENTS

| | | | |
|---|---|---|---|
| 2,844,064 | 7/1958 | Bendett | 84/421 |
| 3,191,484 | 6/1965 | Walling | 84/421 |
| 4,126,075 | 11/1978 | Kurosaki | 84/421 |
| 4,141,272 | 2/1979 | Yanagisawa | 84/421 |

*Primary Examiner*—Lawrence R. Franklin

*Attorney, Agent, or Firm*—W. Melville Van Sciver

[57] ABSTRACT

An outrigger holder assembly for a plurality of percussion type musical instruments including at least one bass drum and one other percussion musical instrument such as a smaller drum or a cymbal, wherein a stable and multi-purpose holder includes an adjustable positioning means for the bass drum which is to be placed on a suitable supporting surface such as a floor and also includes a plurality of slidable and pivotally connected shafts, rods or extension, the lower of which also is supported on the floor. One or more smaller drums than the bass drum or a cymbal may be utilized with the upper extension. Numerous pivoted connections are provided to position parts of the assembly at various desired angles from each other and one adjustable assembly is provided for raising or lowering the height of the drums or cymbal. Preferably, the tightening of some of the pivoted and slidable members to prevent movement thereof after they are set to the desired position is accomplished by use of a single turning key, which is preferably also the drum head tensioning key. The larger drum is also adapted to be supported on the floor by standard supporting spurs, so that with the holder assembly completed, movement of the entire assembly including the larger drum relative to the floor is inhibited to a great degree.

6 Claims, 4 Drawing Figures

OUTRIGGER HOLDER ASSEMBLY FOR PERCUSSION MUSICAL INSTRUMENTS

BACKGROUND OF THE INVENTION

1. Field of the Invention

Heretofore supporting assemblies have been provided for bass drums, drums of other types such as tom-toms or snare drums, cymbals, and the like. However, each of the stands was usually a separate assembly and had no connections between them to provide for stability and flexibility. The multiple grouping ability of the present construction provides for flexibility in floor stand and drum or cymbal arrangements. The player may place and angle each drum or cymbal to be precisely where he wants it and the various components may be positioned within a smaller total area because closer groupings are possible and there is less stand clutter compared to earlier systems. In addition, the design permits the player to increase the number of percussion instruments which he desires to use, and provides virtually an unlimited variety in the composition and placement of the set of drums and/or cymbals.

The construction is anchored firmly to the bass drum by heavy tubing and a large mounting bracket secured to the bass drum and also offers a second upper level of aerial tom-toms or cymbals for the outfit.

2. Description of the Prior Art

As stated above, the prior art consists of multiple stands for various percussion musical instruments in general, and does not have the advantage of the stability, flexibility, and cost savings of the present construction.

BRIEF SUMMARY OF INVENTION

The invention provides an outrigger holder assembly for percussion musical instruments including a bass drum and other percussion musical instruments used by players thereof. It has a number of adjustments for height and angle of the various components.

DETAILED DESCRIPTION OF INVENTION

Figures 1, 2, 3, 4:
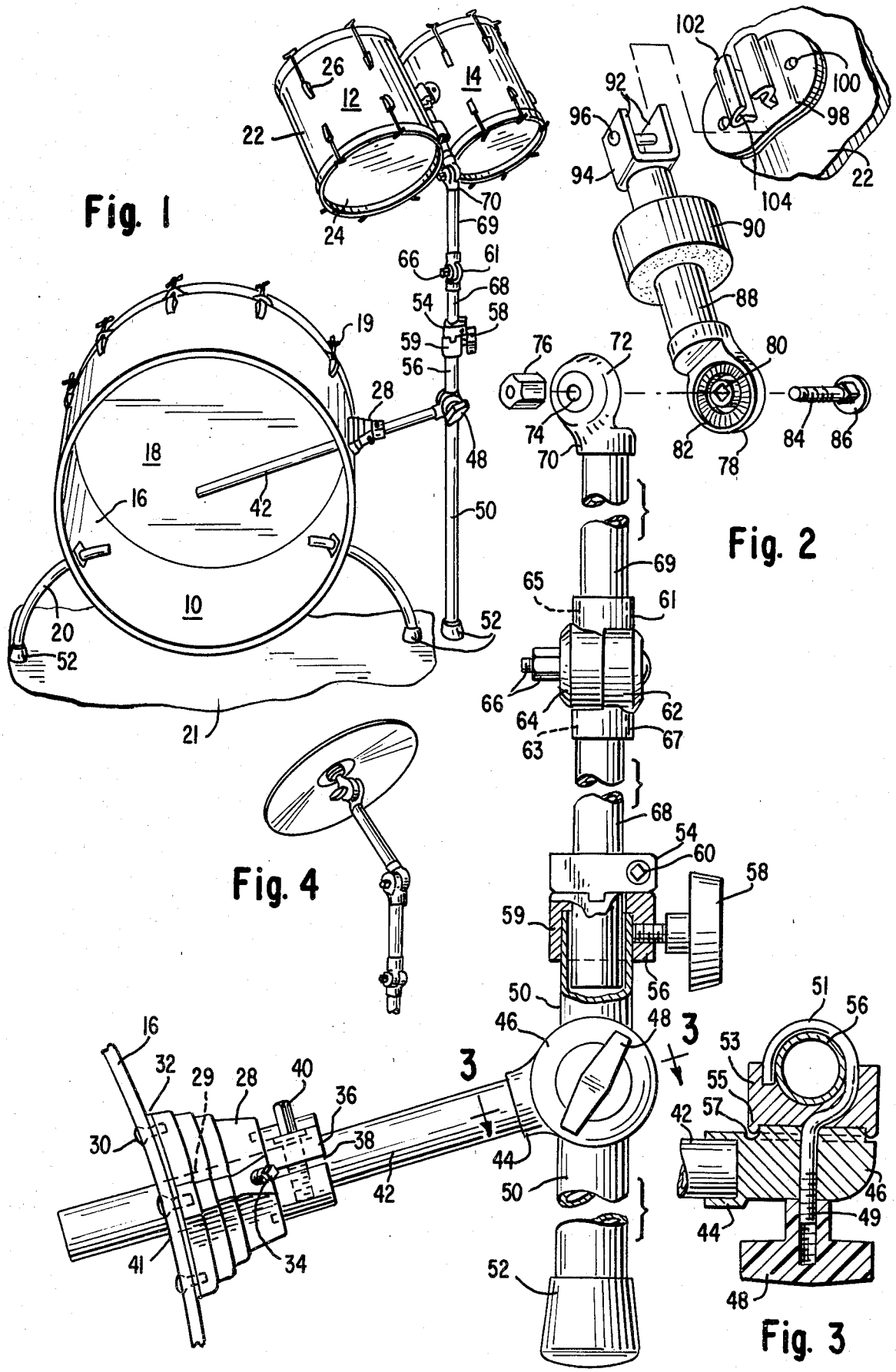
FIG. 1 is a perspective view of the outrigger holder assembly.
FIG. 2 is an exploded view, partly in perspective, of the outrigger assembly shown in FIG. 1.
FIG. 3 is a sectional view of the assembly taken on line 3—3 of FIG. 2.
FIG. 4 is a partial perspective view of the assembly including a cymbal instead of the drums shown in FIG. 1.

FIGS. 1 and 2 show the assembly of the outrigger holder of the present invention and a bass drum 10 is shown supported on a suitable flat surface 21 such as a floor or bandstand. A pair of tom-tom drums 12 and 14 are shown in FIG. 1 and are supported by the assembly.

The bass drum 10 includes a cylindrical shell 16 with a percussion head 18 secured thereto by tension rods 19 of standard construction which include generally, a hexagonal nut 19. The bass drum is provided with claws 20 which support the drum on the floor and crutch-type tips 52 are usually fastened to the end of the claws to prevent scratching of the surface 21 and to inhibit slippage of the bass drum assembly.

The tom-toms 12 and 14 include shells 22 with heads 24 secured thereto by standard tension rods and lugs 26.

A bass drum fitting generally indicated at 28 is secured by screws 30 and a plate 32 to the bass drum shell 16. A set screw including a hexagonal head 34 retains the fitting 28 in position.

In addition, a rod 42 extends through an opening 41 in the fitting 28 and is secured in the position desired with the rod 42 extending into the bass drum as shown in FIG. 2 by a collar 36 which is expandable because of the provision of a slot 38 therein, which collar is tightened or loosened by operation of a bolt 40 also provided with a hexagonal head, preferably of the same size as the hexagonal heads 19 on the bass drum and other parts of the assembly. The rod 42 is secured to a fitting 44 which includes a bass member 46 which is provided with a groove 57 and receives the threaded portion 49 of a member 51 which is curved as shown in FIG. 3 to engage with a rod 50 which is also provided at its bottom end with a crutch-type tip 52 similar to that used on the claws 20. A member 53 having a ridge 55 which cooperates with the groove 57 is secured to the member 46 by the screw assembly 49, 51 so that a wing-nut 58 is operable to position the angle of the rod 42 with respect to the vertical rod 50. This provides for adjustment of the angle of the bass drum to suit the needs of the player.

A rod 68 is provided above the rod 50 and is positioned vertically relative thereto by a member 54 which includes a body portion 59 and a wing-nut 58 which operates a screw member 56 to secure rods 50 and 68 together. In addition, a hexagonal nut and bolt assembly 60 is provided to form a collar around the rod 68 which is utilized to tighten the member 54 with respect to the rod 68. This provides for vertical adjustment of the rods 50 and 68. The rod 68 is provided with a pivot member 62 which is attached thereto and a third rod 69 is secured to a pivot member 65, the pivot member 62 and 64 being retained either in a tightened or loosened position by the nut and bolt assembly 66. The rod 68 extends through an opening 63 in member 62 which is provided with a collar 61 similar to a collar 67 on the pivot member 62.

A collar 70 is secured to the rod 69 and includes a circular pivoted member 72 having an opening 72 provided therein which is adapted to align with an opening 80 in a cooperating pivoting member 78 and a screw 84 having a head 86 adapted to extend through the openings 74 and 80 and be engaged by the nut 76. Serations 82 are preferably disposed on the interior surfaces of both the members 72 and 82 so that the parts will be tightly locked in position when the nut 76 is tightened on the screw 84. A fourth rod 88 extends from and is attached to the pivot member 80 and the upper portion thereof is provided with a U-shaped attaching member 94 which forms upright members 92. A bolt, or reinforcing member 96 extends between the portions 92 of the member 94. Preferably a cushion of foam rubber, for example, indicated at 90, is placed on the rod 88 to cushion any movement between the upper drums 12 and 14.

A plate 98 is secured to the drum shells 22 and 24 and includes vertical member 102 forming channels 104 for reception of the portions 92 of the channel member 94 so that the drums 12 and 14 are held rigidly with respect to the assembly.

When the foregoing parts are assembled the bass drum 10 is movable both laterally and angularly with respect to the rod 50. In addition, the rods 50 and 68 may be adjusted to control the heighth of the drums 12 and 14 above the floor and the bass drum 10. Furthermore, the angular position of the drums 12 and 14 may be adjusted by adjusting the pivot 61 or the pivot 72, 82 so that the exact angle of the drums 12 and 14 may be positioned at the desire of the player. As shown in FIG. 4, the same thing is true of a cymbal if it is mounted on the assembly in place of the drums 12 and 14. Therefore, great flexibility of the positioning of the bass drum and the upper drums or cymbal with a minimum of space requirement and of parts is accomplished. Furthermore the assembly is extremely stable and the tendency of the bass drum to move as it is played is greatly inhibited if not entirely prevented.

Various modifications may be made in the form of the invention without departing from the principles disclosed in the foregoing. It is my intention therefore that the accompanying claims be construed as broadly as possible consistent with the prior art.

What is claimed is:

1. An outrigger holder assembly for percussion musical instruments including at least one bass drum adapted to be placed on a supporting surface and at least one other percussion musical instrument, said assembly comprising a first vertical support member adapted to rest on said supporting surface, a rigid bass drum positioning member connected between the bass drum and the vertical support member, a pivotal connection between the vertical support and the bass drum positioning member, means affording adjustment of the distance between the vertical supporting member and the bass drum, an extension member secured to the first vertical support member, means for vertically adjustably connecting the first vertical support member and the extension member together, a first pivot means positioned at the end of the extension member spaced from the connection with the vertical support, a second extension member including a second pivot means connected to said first pivot means at said end of the extension member and provided with a second pivot means at the other end, a third extension member provided with a third pivot means connected to said second pivot member at one end and including supporting means cooperating with the other percussion instrument to support the same in detachable relationship, and means for fixing the rotative position of said pivots and the vertical position of said adjustable connection and for readily releasing the various fixing means for said pivots and said adjustable connection.

2. An outrigger assembly as claimed in claim 1 wherein at least some of the supporting members are formed of hollow material.

3. An outrigger assembly as claimed in claim 2 wherein the extension member secured to the first vertical support member is slightly smaller in its external dimensions than the interior of the supporting member.

4. An outrigger assembly as claimed in claim 1 wherein the bass drum positioning member extends through an opening in the bass drum.

5. An outrigger assembly as claimed in claim 1 wherein at least some of the last means are provided with similar portions adapted to be tightened or loosened by a common tool.

6. An outrigger assembly as claimed in claim 1 wherein at least some of the supporting members are formed of hollow rods.

* * * * *